US007744847B2

(12) United States Patent
Snyders

(10) Patent No.: US 7,744,847 B2
(45) Date of Patent: Jun. 29, 2010

(54) UPGRADING OF ZIRCON

(75) Inventor: Ettienne Snyders, Pretoria (ZA)

(73) Assignee: The South African Nuclear Energy Corporation Limited, District Brits (ZA)

( * ) Notice: Subject to any disclaimer, the term of this patent is extended or adjusted under 35 U.S.C. 154(b) by 147 days.

(21) Appl. No.: 11/579,752

(22) PCT Filed: May 24, 2005

(86) PCT No.: PCT/IB2005/051688

§ 371 (c)(1),
(2), (4) Date: Jun. 5, 2007

(87) PCT Pub. No.: WO2005/116277

PCT Pub. Date: Dec. 8, 2005

(65) Prior Publication Data

US 2007/0292332 A1 Dec. 20, 2007

(30) Foreign Application Priority Data

May 27, 2004 (ZA) ..... 04/4157

(51) Int. Cl.
*C01G 25/06* (2006.01)

(52) U.S. Cl. ..... 423/608; 423/594.12

(58) Field of Classification Search ..... 423/608, 423/594.12

See application file for complete search history.

(56) References Cited

U.S. PATENT DOCUMENTS

| | | | | |
|---|---|---|---|---|
| 5,228,910 | A | 7/1993 | Joyce et al. | |
| 6,090,353 | A | 7/2000 | Faulkner et al. | |
| 7,063,824 | B1 * | 6/2006 | Coetzee et al. | 423/71 |

FOREIGN PATENT DOCUMENTS

| | | |
|---|---|---|
| EP | 0 670 376 | 9/1995 |
| WO | WO 01/64586 | 9/2001 |
| WO | WO 03/097533 | 11/2003 |

OTHER PUBLICATIONS

Brennan et al., 1984, "Chemical Beneficiation of Zircon Concentrated in Western Australia", Int. J. of Mineral Processing, 13:251-258.

* cited by examiner

*Primary Examiner*—Timothy C Vanoy
*Assistant Examiner*—Michelle Hou
(74) *Attorney, Agent, or Firm*—Kenyon & Kenyon LLP

(57) ABSTRACT

A process for upgrading an inferior grade of zircon to a superior grade thereof includes mixing the inferior grade of zircon, in comminuted form, with at least one mineralizer, to obtain a zircon/mineralizer mixture, which is a calcined product. The calcined product is washed, and thereafter, in a comminution step, the washed calcined product is comminuted to obtain a superior grade of zircon, which is suitable for use as a glaze opacifier.

7 Claims, 1 Drawing Sheet

UPGRADING OF ZIRCON

Figure 1:
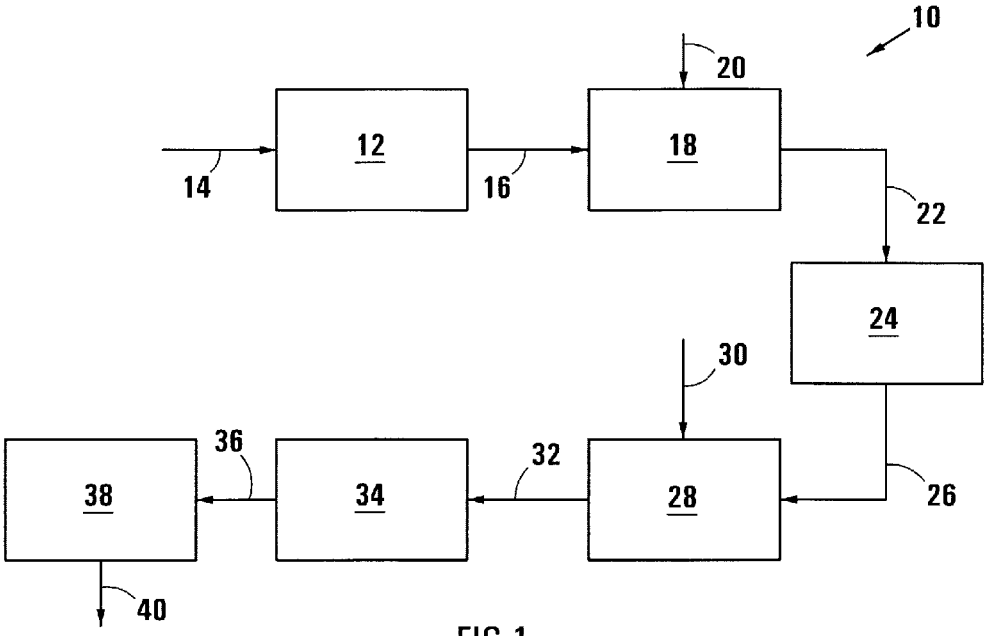

This invention relates to the upgrading of zircon. In particular, it relates to a process for upgrading an inferior grade of zircon to a superior grade thereof, which is suitable for use as a ceramic glaze opacifier.

Zircon is commonly used as an opacifier in ceramic glazes. Zircon opacity in ceramic glazes results from the reflection and refraction of light by zircon phases and particles suspended in the clear glaze matrix. To be opaque, the glaze layer must contain finely subdivided and highly dispersed zircon grains, preferably having rough edges, with the zircon having a refractive index different to that of the matrix. Thus, in general, the smaller the opacifying zircon particles and the higher their number concentration, the more effective the opacity of the zircon. Similarly, the higher the purity or grade of the opacifying zircon, the whiter the glazed product will appear.

In order for zircon to be used as an opacifier in ceramic glazes, it must be milled down extensively to either flour or opacifier particle size specification. However, the mineral zircon is very hard and therefore difficult to mill, and a major cost factor in the production of a zircon opacifier is thus the cost of milling it. Conventionally, no treatment of the zircon is carried out prior to final milling thereof to produce different opacifier particle size products. Thus, hitherto, the quality of the opacifier has been determined only by the purity or grade of the zircon that is milled down to the various opacifier particle size products. Typically, the only zircon purity grade that is considered acceptable for use as an opacifier is prime or premium grade as opposed to standard or other inferior grades which are unacceptable. Furthermore, depending on the intended commercial application, a number of zircon milled products are produced with varying grain sizes and prices to match. The finer the milled zircon product, the more expensive it is. The most common milled zircon products are zircon having a flour size specification, which is 325-mesh ($d_{95}$ of 45 microns), and zircon having an opacifier size specification, wherein all particles typically are either smaller than 9 or 6 or 5 or 3 microns, depending on the application of the milled zircon.

An aim of this invention therefore is to add value to an inferior purity grade of zircon concentrate, eg standard grade, by upgrading it to a superior opacifier grade suitable for use in the high-grade opacified glazing industry.

According to the invention, there is provided a process for upgrading an inferior grade of zircon to a superior grade thereof which is suitable for use as a glaze opacifier, which process includes

- mixing a comminuted inferior grade of zircon with at least one mineralizer, to obtain a zircon/mineralizer mixture;
- calcining the zircon/mineralizer mixture, to produce a calcined product;
- washing the calcined product; and
- in a comminution step, comminuting the washed calcined product, to obtain a superior grade of zircon which is suitable for use as a glaze opacifier.

By 'inferior grade of zircon' is meant zircon which cannot be used directly as an opacifier in a ceramic glaze. Thus, an inferior grade of zircon contains one or more unacceptable impurity, such as $Fe_2O_3$, $Al_2O_3$ and/or $TiO_2$, with the impurity being present in a sufficiently high concentration so as to preclude the zircon from being used directly as an opacifier in a ceramic glaze. Thus, the inferior grade of zircon may be standard grade zircon, or an even more inferior grade of zircon, such as foundry grade zircon. Standard grade zircon typically contains up to 0.2 wt % $Fe_2O_3$ and up to 0.25 wt % $TiO_2$. Foundry grade zircon typically contains up to 0.25 wt % $Fe_2O_3$ and up to 0.5 wt % $TiO_2$.

In contrast, prime grade zircon which, as indicated hereinbefore, is suitable for use as an opacifier, usually contains a maximum of 0.06 wt % $Fe_2O_3$ and a maximum of 0.12 wt % $TiO_2$.

The zircon feedstock, ie the inferior grade of zircon, is typically obtained as a by-product in titanium mineral production, and is then usually available as a dry particulate concentrate or mineral extract.

It is to be appreciated that the particle size of the inferior grade of zircon is immaterial, and does not influence its opacifying properties, or lack thereof.

The process may include, in a first comminution step, comminuting the inferior grade of zircon, with the comminution step in which the washed calcined product is comminuted thus constituting a second comminution step.

In the first comminution step, the inferior grade of zircon may be comminuted, eg milled, sufficiently finely so that it passes through a 200 mesh sieve, ie so that all zircon particles are 74 microns or smaller. For example, it may be comminuted down to zircon flour size specification or 325 mesh in which $d_{95}$ for all particles is 45 microns.

The mineralizer, whose function it is to reduce the calcination reaction temperature and/or to catalyze the calcination reaction, may be an alkaline metal halide, particularly an alkaline metal fluoride such as NaF, or any other alkaline mineralizer such as $(NH_4)_2SO_4$.

The comminuted zircon and the mineralizer are preferably mixed sufficiently so that the mixture is a homogeneous blend.

The calcination may be effected in an air furnace or by any other suitable means, eg in a rotary kiln, and the calcination temperature may be from 600° C. to 900° C. The calcination of the zircon in the presence of the mineralizer serves, amongst others, to remove unwanted excess impurities, particularly $Fe_2O_3$ and $Al_2O_3$, present in the inferior grade of zircon.

The washing of the calcined product may be by means of water, and serves to remove excess mineralizer.

In the second comminution step, the washed calcined product may be comminuted, eg milled, down to a particle size smaller than 1.5 microns, ie $d_{50}<1.5$ microns as measured with a Sedigraph 5100 Particle size analyser, which is the accepted specification for a zircon superfine opacifier product. However, it can instead be comminuted down to zircon fine opacifier product specification, in which $d_{50}<2.1$ microns, or to zircon microfine product specification, in which $d_{50}<1.8$ microns, depending on the envisaged application of the final product.

Preferably, wet milling is employed in the second comminution step. The process may then include drying the superior grade zircon that is obtained from the second comminution stage.

The superior grade of zircon that is obtained thus contains lower levels of the impurities, eg $Fe_2O_3$ and $Al_2O_3$, which detrimentally affect the opacifying properties of the zircon. The opacifying properties of the superior grade of zircon that is obtained are thus similar to, or better than, those of zircon prime grade. The superior grade of zircon can thus be used as an opacifier in ceramic glazes.

The invention will now be described in more detail with reference to the accompanying drawings.

IN THE DRAWINGS

Figure 2:
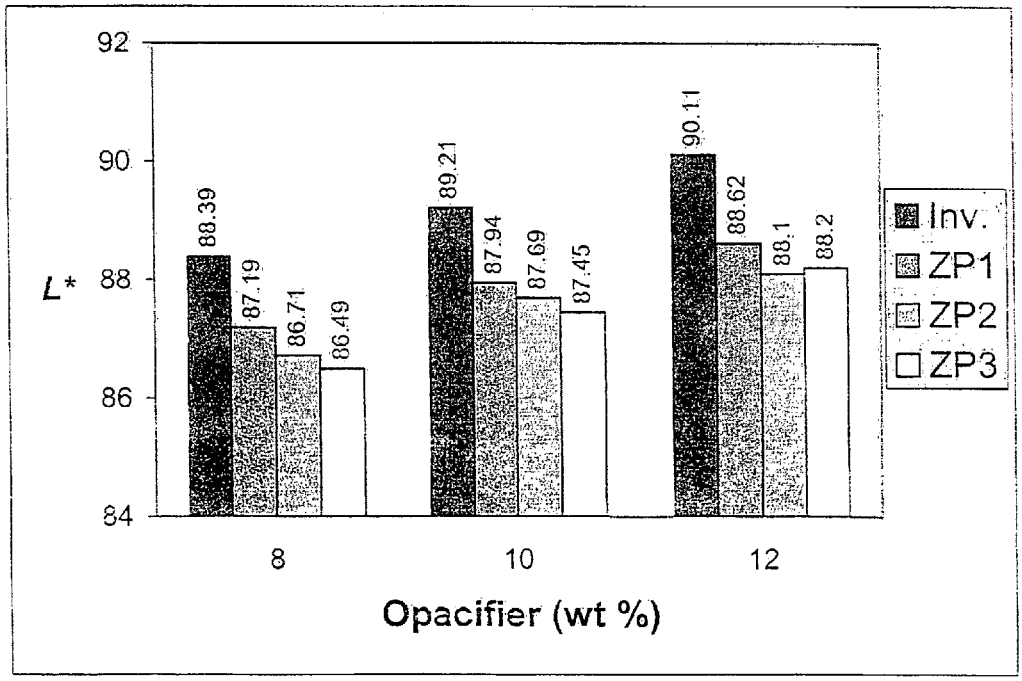

FIG. 1 depicts a simplified flow diagram of a process according to the invention for upgrading an inferior grade of zircon to a superior grade thereof; and FIG. 2 shows a graph of CIE L* parameters for different zircon opacifier concentrations, in accordance with Example 3.

Referring to FIG. 1, reference numeral 10 generally indicates a process for upgrading an inferior grade of zircon to a superior grade of zircon.

The process 10 includes a first comminution stage 12 with a zircon ($ZrSiO_4$) feed line 14 leading into the stage 12.

A comminuted zircon transfer line 16 leads from the first comminution stage 12 to a mixing stage 18, with a mineralizer addition line 20 also leading into the mixing stage 18.

A transfer line 22 leads from the mixing stage 18 to an air furnace or calciner 24. A calcined product transfer line 26 leads from the furnace 24 to a washing stage 28, with a wash water addition line 30 also leading into the stage 28.

A transfer line 32 leads from the wash stage 28 to a second comminution or milling stage 34, with a zircon withdrawal line 36 leading from the stage 34 to a drier 38. A product withdrawal line 40 leads from the drier 38.

In use, a standard grade zircon concentrate, as hereinbefore defined, is introduced into the first comminution stage 12, along the flow line 14. In the stage 12, the standard grade zircon is pre-milled down to 325 mesh.

The resultant comminuted zircon passes along the line 16 to the mixer 18 where it is mixed with mineralizers that are added along the line 20. The comminuted zircon and the neutralizers are mixed into a homogeneous blend.

The mixture then passes along the line 22 to the air furnace 24 where it is calcined at a temperature between 600° C. and 900° C. for a sufficient period of time so as to produce a raw calcined product. Excess impurities, particularly $Fe_2O_3$ and $Al_2O_3$, present in the standard grade zircon are removed during the calcination process. This product thereafter passes along the line 26 to the washing stage 28 where it is water washed to remove excess mineralizer.

The washed zircon product passes along the line 32 into the second comminution stage 34 where it is wet milled down to a particle size smaller than 1.5 microns, ie zircon superfine opacifier product. This zircon then passes along the flow line 36 to the drier 38 where it is dried, with the dried product being withdrawn along the line 40. The resultant superfine zircon product is suitable for use as a opacifier in ceramic glazes.

The process 10 was simulated on laboratory scale by milling (stage 12) a batch of standard grade zircon concentrate to zircon flour size of 325 mesh. The mean particle size, $d_{50}$, was determined at 12.3 microns with a Sedigraph 5100 particle size analyzer.

The resultant pre-milled zircon was mixed with two mineralizers, NaF and $(NH_4)_2SO_4$, in a Y-cone tumbler mixer (stage 18), and thereafter calcined at 700° C. in the air furnace 24, and for a soaking time of 5 minutes after temperature equilibrium had been reached, to allow reaction of the zircon and the mineralizers to take place to produce the raw calcined product. The raw calcined product was washed in cold water (stage 28) to remove excess mineralizers and impurities present in the calcined product. The resultant washed product was then wet milled, in a simulation of the second comminution stage 34, in an MMS series RAPID mill with a 300 ml porcelain milling jar using yttria-stabilized zirconia milling media in order to eliminate any contamination.

EXAMPLE 1

A blend of 1 mole of standard grade 325-mesh zircon flour (produced in the stage 12 as described hereinbefore), 0.2 moles NaF and 0.2 moles $(NH_4)_2SO_4$ was calcined to a raw calcined product, which is thus an upgraded opacifier, according to the invention. After washing the raw calcined product, the resulting raw opacifier was comminuted to a $d_{50}$ of 1.3 microns as measured with a Sedigraph 5100 particle size analyzer.

The calcined product was benchmarked at the accredited laboratory of Ceram Research in Stoke-on-Trent, England, against an acceptable standard, namely Zircosil 5 (trade mark), which is a prime grade opacifier used in the ceramics industry and has a particle size ($d_{50}$ value) of 1.5 microns, i.e. it is a superfine prime grade opacifier product. The colour of the opacifier product, after application to a suitable ceramic bisque tile, was assessed on the grounds of the L*, a* and b* parameters, calculated from diffuse reflectance specra, as measured by a Hunterlab colourmeter according to the method recommended by the Commission Internationale de l'Eclairage (CIE). The results of the colour measurements for both the product of the invention and the benchmark are given in Table 1.

TABLE 1

CIE L*, a* and b* parameters for Zircon Opacifiers

| Sample | L*<br>L* = 100 → white<br>L* = 0 → black | a*<br>a*+ → red<br>a*− → green | b*<br>b*+ → yellow<br>b*− → blue |
|---|---|---|---|
| Benchmark: Zircosil 5 | 92.39 | 1.10 | 4.89 |
| Invention: Upgraded zircon | 93.47 | 0.61 | 3.53 |

In Table 1, the parameter L* indicates the whiteness of the tile on a scale of 100 for white and 0 for black. An L*-value of 93.47 was obtained for the upgraded zircon compared to L*=92.39 for the benchmark. This is a significant result in view of the fact that a difference of more than 1 is considered substantial in the glazing industry, indicating that the upgraded zircon is superior even to the benchmark.

Colourwise, a positive b*-value indicates yellow on the tile. In Table 1, the improvement in b* (less yellow) supports the finding that the upgraded zircon of the invention is superior to the benchmark. Similarly, the improvement in the positive a*-value, indicating less red on the tile, reinforces the conclusion that the upgraded zircon sample imparts a whiteness on the tile that is more brilliant than that of the benchmark. Therefore, the advantage of using the upgraded zircon of the invention for a superior opacifier in glazes as a substitute for untreated prime grade opacifier is apparent.

In order to perform chemical analyses to evaluate the influence of the mineralizers during the calcining step on the treated zircon concentrate, a batch of 500 g of upgraded zircon was prepared and evaluated against a control sample of untreated 325-mesh standard grade zircon. The chemical analyses for Fe, Ca and Al content were carried out with the aid of X-ray Fluorescence Spectroscopy. These chemical analyses are reflected in Table 2.

TABLE 2

Chemical analyses for zircon opacifier

| Impurity | Impurity Concentration (wt %) Control: Standard zircon 325-mesh | Invention: Upgraded zircon |
|---|---|---|
| $Fe_2O_3$ | 0.20 | 0.04 |
| CaO | 0.12 | 0.02 |
| $Al_2O_3$ | 0.53 | 0.12 |

Table 2 shows the surprising result that the calcining step in the presence of the mineralizers has reduced the Fe, Ca and Al concentrations in the upgraded zircon sample by a factor ranging between about 4 and 6 times.

EXAMPLE 2

A sample of the same batch of comminuted calcined product as in Example 1 was again benchmarked (Sample ZT, Table 3), but this time against three commercially available South African prime grade superfine zircon opacifier products, designated ZP1, ZP2 and ZP3 respectively. A 12 wt % opacifier/transparent glaze mixture of each sample was prepared, mixed and applied to a 152 mm square Johnson bisque ceramic tile by means of a high-pressure spray gun to a total weight gain of 21 gram and fired in a muffle furnace at a temperature of 1080° C. The tiles were analysed in the Applicant's laboratories according to the CIE prescribed method and the results of the L*, a* and b* parameters for each of the product of the invention and the benchmarks are given in Table 3.

TABLE 3

CIE L*, a* and b* parameters for zircon opacifiers

| Sample | L* L* = 100 → white L* = 0 → black | a* a*+ → red a*− → green | b* b*+ → yellow b*− → blue |
|---|---|---|---|
| Benchmark: | | | |
| ZP1 | 88.62 | 2.08 | 5.65 |
| ZP2 | 88.20 | 2.25 | 5.77 |
| ZP3 | 88.10 | 2.26 | 6.14 |
| Invention: | | | |
| Upgraded zircon: ZT | 90.11 | 1.57 | 3.44 |

As illustrated in Table 3, the highest L* value amongst the benchmarks corresponds to sample ZP1 (88.62), while samples ZP2 and ZP3 have slightly lower values of 88.20 and 88.10 respectively. A substantial increase in the L* value to 90.11 is observed for the upgraded zircon sample, giving it a much whiter appearance compared to the prime grade superfine benchmark samples. ZT produces lower values for a* and b*, indicating a tendency to achromatism. The a* values for the benchmark samples, ZP1, ZP2 and ZP3, vary from 2.08 to 2.26 compared to 1.57 for the upgraded zircon sample according to the invention, while the b* values vary from 5.65 to 6.14 for the benchmarks, compared to 3.44 for the upgraded zircon sample.

EXAMPLE 3

In this example, the influence of the opacifier concentration in the opacifier/glaze mixture applied to a ceramic tile was determined. The upgraded zircon opacifier product was benchmarked against the same 3 superfine prime grade zircon opacifiers, ZP1, ZP2 and ZP3 as in Example 2. A range of three concentrations of 8, 10 and 12 wt % opacifier was selected to cover the typical concentrations used in industry and also to represent a reasonable variation in the L* values. To facilitate the unbiased comparison of the test tiles, a fixed weight of opacifier/glaze mixture was applied per unit area by means of a high-pressure spray gun. Uniformity of application was monitored by first weighing the test tiles, and then spraying the mixture to a predetermined dry weight gain of 21 gram.

The results of the CIE L*, a* and b* parameters for both the product of the invention and the benchmark samples are given in FIG. 2. It is evident from the test results that the L* values for the upgraded zircon sample over the selected range of opacifier concentrations are consistently higher than those obtained with ZP1-ZP3. FIG. 2 also indicates that the L* value of 88.39 obtained for the tile with the upgraded zircon at the lowest opacifier concentration (8 wt %) is even better than the values obtained for the two benchmarks ZP2 and ZP3 (88.10 and 88.20 respectively) at 12 wt % opacifier. Only sample ZP1 with an L* value of 88.62 at 12 wt % opacifier is marginally better. However, having an L* value in the same range as ZP1-ZP3 at 12 wt % opacifier a further unexpected benefit of a potential saving of up to 33 wt % opacifier may be achieved when upgraded zircon product according to the invention is applied on a ceramic tile instead of the current prime grade superfine zircon opacifier products.

EXAMPLE 4

In this example, the influence of the mineralizers on the milling characteristics of the upgraded zircon sample was determined. 1.5 kg of untreated standard grade zircon 325-mesh and 1.5 kg of treated zircon each were milled down in a roller jar mill under the same conditions as described hereinbefore. Again the milling media used in this comparison test was yttria-stabilized zirconia. Particle size measurements on the milled samples were carried out on a Sedigraph 5100 particle size analyzer at given time intervals and the results are summarized in Table 4.

TABLE 4

Milling tests on zircon opacifier

| Time (hours) | Standard Untreated zircon 325 mesh $d_{50}$ (μm) | Invention Upgraded zircon $d_{50}$ (μm) |
|---|---|---|
| Unmilled | 12.3 | 14.8 |
| 1 | 11.2 | 11.1 |
| 2 | 9.9 | 9.6 |
| 4 | 8.4 | 7.6 |
| 6 | 7.4 | 6.7 |
| 8.5 | 6.8 | 5.6 |
| 10 | 6.3 | 5.2 |

TABLE 4-continued

Milling tests on zircon opacifier

| Time (hours) | Standard Untreated zircon 325 mesh $d_{50}$ (μm) | Invention Upgraded zircon $d_{50}$ (μm) |
|---|---|---|
| 12.5 | 5.8 | 4.6 |
| 15 | 5.5 | 4.2 |

Surprisingly, it was found that calcining in the presence of mineralizers in an air furnace improves the milling characteristics of 325-mesh standard grade zircon. In Table 4, a $d_{50}$ of 5.6 microns was achieved for the upgraded zircon after only 8.5 hours of milling compared to the 15 hours of milling time necessary to achieve the same particle size for the untreated 325-mesh standard grade zircon.

The Applicant has thus found that a significant improvement in the opacifier properties as well as the milling characteristics of an inferior purity grade of zircon can be achieved by an upgrading step, which involves calcining the zircon in the presence of mineralizers.

The Applicant has found that the following benefits are achieved by means of the process of the invention:

- superior zirconium-bearing opacifier for glazes used in the ceramic industry with improved whiteness on ceramic tiles, can be produced
- reduction in milling time of zircon concentrate to final opacifier specification after a calcining treatment step with mineralizers, is possible
- removal of undesirable trace elements, such as Fe, Ca, and Al, in particular Fe, which is detrimental to the opacity properties of zircon, is achieved by the calcination step
- reduction in quantity of zircon needed to obtain the same opacifying properties as conventional zircon opacifier grades, is possible
- inferior grades of zircon, eg zircon standard grade, can be treated via the upgrading process to obtain the same level of opacifying properties as premium/prime grade zircon concentrate.

The invention claimed is:

1. A dry process for upgrading an inferior grade of zircon to a superior grade thereof which is suitable for use as a glaze opacifier, which process includes mixing a comminuted inferior grade of zircon with NaF and/or $(NH_4)_2SO_4$ as a mineralizer, to obtain a comminuted zircon/mineralizer mixture in the form of a homogeneous blend;

calcining the comminuted zircon/mineralizer mixture, to produce a calcined product;

washing the calcined product; and in a comminution step, comminuting the washed calcined product, to obtain a superior grade of zircon which is suitable for use as a glaze opacifier.

2. A process according to claim 1 which includes, in a first comminution step, comminuting the inferior grade of zircon, with the comminution step in which the washed calcined product is comminuted thus constituting a second comminution step.

3. A process according to claim 2 wherein, in the first comminution step, the inferior grade of zircon is comminuted sufficiently finely so that all zircon particles are 74 microns or smaller.

4. A process according to claim 2, wherein the washing of the calcined product is by means of water.

5. A process according to claim 2 wherein, in the second comminution step, the washed calcined product is comminuted down to a particle size smaller than 2.1 microns.

6. A process according to claim 2, wherein wet milling is employed in the second comminution step, with the process including drying the superior grade zircon that is obtained from the second comminution step.

7. A process according to claim 1, wherein the calcination temperature is from 600° C. to 900° C.

* * * * *